US011076229B2

(12) United States Patent
Park et al.

(10) Patent No.: US 11,076,229 B2
(45) Date of Patent: Jul. 27, 2021

(54) GRILL-INTEGRATED LOW-PASS FILTER AND SPEAKER INCLUDING THE SAME

(71) Applicant: BUJEON CO., LTD., Ansan-si (KR)

(72) Inventors: Minkoo Park, Hwaseong-si (KR); Seungcheol Lee, Ansan-si (KR); Seungwoo Chun, Hwaseong-si (KR); Junho Yun, Ansan-si (KR); Halim Kim, Ansan-si (KR)

(73) Assignee: BUJEON CO., LTD., Ansan-si (KR)

( * ) Notice: Subject to any disclaimer, the term of this patent is extended or adjusted under 35 U.S.C. 154(b) by 0 days.

(21) Appl. No.: 16/751,221

(22) Filed: Jan. 24, 2020

(65) Prior Publication Data

US 2021/0185444 A1 Jun. 17, 2021

(30) Foreign Application Priority Data

Dec. 11, 2019 (KR) ..... 10-2019-0164489

(51) Int. Cl.

| | |
|---|---|
| ***H04R 3/08*** | (2006.01) |
| ***H04R 1/02*** | (2006.01) |
| ***H04R 1/28*** | (2006.01) |
| ***H04R 9/02*** | (2006.01) |

(52) U.S. Cl.

CPC ..... *H04R 3/08* (2013.01); *H04R 1/023* (2013.01); *H04R 1/2803* (2013.01); *H04R 1/2853* (2013.01); *H04R 1/2857* (2013.01); *H04R 9/025* (2013.01); *H04R 2201/02* (2013.01)

(58) Field of Classification Search

CPC ..... H04R 1/023; H04R 1/2853; H04R 1/2857

See application file for complete search history.

(56) References Cited

U.S. PATENT DOCUMENTS

| | | | | |
|---|---|---|---|---|
| 2,656,004 A * | 10/1953 | Olson | ..... | H04R 1/22 181/295 |
| 5,579,398 A * | 11/1996 | Ewens | ..... | H04M 1/03 181/138 |
| 2005/0135648 A1* | 6/2005 | Lee | ..... | H04R 19/04 381/355 |

(Continued)

FOREIGN PATENT DOCUMENTS

| | | |
|---|---|---|
| KR | 10-0825335 B1 | 4/2008 |
| KR | 10-1535916 B1 | 7/2015 |
| KR | 10-1634236 B1 | 6/2016 |

*Primary Examiner* — Mark Fischer

(74) *Attorney, Agent, or Firm* — KORUS Patent, LLC; Seong Il Jeong

(57) ABSTRACT

Disclosed herein is a grill-integrated low-pass filter. The grill-integrated low-pass filter includes a conduit-type low-pass filter part in which a sound conduit is formed inside an internal space of a grill, which is a mechanism assembled and used in a housing, in an empty tubular form, and the conduit-type low-pass filter part is integrated with the grill. According to the present invention, there are provided the grill-integrated low-pass filter that is designed in a structure in which the sound conduit is formed inside the internal space of the grill disposed and used in a housing in order to protect a speaker driver, etc. and is thus fabricated in a grill-integrated form, thereby achieving the effects of improving the sound quality of the speaker and reducing characteristic deviations in a low-frequency band.

6 Claims, 5 Drawing Sheets

(56) References Cited

U.S. PATENT DOCUMENTS

| | | | | |
|---|---|---|---|---|
| 2008/0101640 | A1* | 5/2008 | Ballad | H04R 1/2857<br>381/338 |
| 2012/0008814 | A1* | 1/2012 | Alwicker | H04R 1/1058<br>381/380 |
| 2013/0315431 | A1* | 11/2013 | Grinker | H04R 1/1091<br>381/380 |
| 2019/0116411 | A1* | 4/2019 | Duckwall | H04R 1/1016 |

* cited by examiner

GRILL-INTEGRATED LOW-PASS FILTER AND SPEAKER INCLUDING THE SAME

CROSS-REFERENCE TO RELATED APPLICATION

This application claims the benefit of Korean Patent Application No. 10-2019-0164489 filed on Dec. 11, 2019, which is hereby incorporated by reference herein in its entirety.

BACKGROUND

1. Technical Field

The present invention relates generally to a grill-integrated low-pass filter and a speaker including the same, and more specifically to a grill-integrated low-pass filter that is designed in a structure in which a conduit is formed in a grill disposed and used in a housing in order to protect a speaker driver and an internal circuit and is thus fabricated in a grill-integrated form, thereby improving the sound quality of the speaker, and a speaker including the grill-integrated low-pass filter.

2. Description of the Related Art

In general, speakers employ a principle opposite to that of a microphone that converts sound waves into electric signals. In such a speaker, when a current enters a coil, a magnet becomes an electromagnet having its own magnetic field, and comes into contact with a surrounding continuous magnetic field. Accordingly, the coil is vibrated by an attractive force or repulsive action that alternately pulls or pushes sound waves, a diaphragm is vibrated, and thus sound waves are generated, thereby outputting sound.

Such a speaker is equipped with an acoustic filter configured to adjust tone according to the amount of specific frequency in order to obtain desirable sound quality, thereby representing a variety of types of sounds.

The acoustic filter may be classified as a low-pass filter configured to pass a low-frequency band (low frequencies) and block a high-frequency band (high frequencies) or a high-pass filter configured to pass a high-frequency band (high frequencies) and block a low-frequency band (low frequencies).

In this case, the low-pass filter is widely used in a woofer, which is a speaker for reproducing sound in a low-frequency range of about 30 to 400 Hz.

In particular, the low-pass filter is applied to a multi-driver set, and is used to control useless mid-high frequency band ones in the characteristics of a woofer. However, the conventional low-pass filter used in a woofer has a problem in that sound quality is lost, inconvenience arises in that electromagnetic parts need to be mounted to reduce such sound quality loss, and it is difficult to reduce characteristic variations in a low-frequency band. In particular, it is difficult to adjust the length and sectional area of the conventional low-pass filter, so that it is difficult to implement rolling off characteristics in a deep base of 100 Hz or lower, and it is difficult to improve workability and reduce characteristic variations. In other words, the conventional low-pass filter has its technical limitations on achieving maximum effects.

Meanwhile, in the related arts, Korean Patent No. 10-0825335 proposes a hybrid structure in which an acoustic filter configured such that a sound path is formed by a frame structure is formed in a second speaker, i.e., a dynamic driver unit, and Korean Patent Publication No. 10-1535916 proposes a structure in which a communication hole and an acoustic filter are formed in an earpiece.

SUMMARY

The present invention has been conceived to overcome the above-described problems, and an object of the present invention is to provide a grill-integrated low-pass filter that is designed in a structure in which a sound conduit is formed inside the internal space of a grill disposed and used in a housing in order to protect a speaker driver, etc. and is thus fabricated in a grill-integrated form, thereby improving the sound quality of the speaker, and a speaker including the grill-integrated low-pass filter.

An object of the present invention is to provide a grill-integrated low-pass filter that can improve workability and also reduce characteristic deviations in a low-frequency band because the inconvenience of assembling additional parts into a speaker mechanism can be eliminated, and that can achieve lossless sound quality because the low-pass filter is implemented in a form in which an electromagnetic part is not used, and a speaker including the grill-integrated low-pass filter.

An object of the present invention is to provide a grill-integrated low-pass filter that is designed in a structure in which a conduit is formed in a grill itself, i.e., a speaker mechanism, so that the length and sectional area thereof are variable, through which rolling off characteristics can be implemented even in a deep base equal to or lower than 100 Hz, and a speaker including the grill-integrated low-pass filter.

In order to accomplish at least one of the above objects, the present invention provides a grill-integrated low-pass filter including a conduit-type low-pass filter part in which a sound conduit is formed inside an internal space of a grill, which is a mechanism assembled and used in a housing, in an empty tubular form, wherein the conduit-type low-pass filter part is integrated with the grill.

The conduit-type low-pass filter part may be formed in a single layer or two or more-layer structure with respect to the empty tubular sound conduit, a sound conduit entrance may be located on the inner side of the grill, and a sound conduit exit may be provided on the outer side of the grill to be exposed to the outside.

The conduit-type low-pass filter part may be formed in any one selected from the group consisting of a spiral shape, an S shape, an inverted and reversed "L" shape, and an "L" shape.

The conduit-type low-pass filter part may have a variable shape structure.

The conduit-type low-pass filter part may have a variable length and sectional area.

The conduit-type low-pass filter part may be configured such that the length thereof is long and the sectional area thereof is short, and thus rolling off may be formed in a low-frequency band.

In order to accomplish at least one of the above objects, the present invention provides a speaker including: a housing; a sound conversion unit mounted inside the housing; and a grill-integrated low-pass filter assembled into the housing; wherein the grill-integrated low-pass filter is one of the grill-integrated low-pass filters set forth above.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

The objects and advantages of the present invention and technical configurations for achieving them will be apparent from embodiments which will be described in detail below in conjunction with the accompanying drawings. In the following description of the present invention, when it is determined that a detailed description of a related well-known function or configuration may make the gist of the present invention unnecessarily obscure, it will be omitted.

Throughout the specification and the claims, when a part is described as "including" or "comprising" a certain component, it means that it can further include one or more other components rather than excluding one or more other components, unless specifically stated otherwise. Meanwhile, in an embodiment of the present invention, each component, function block or means may include one or more subcomponents.

Figure 1:
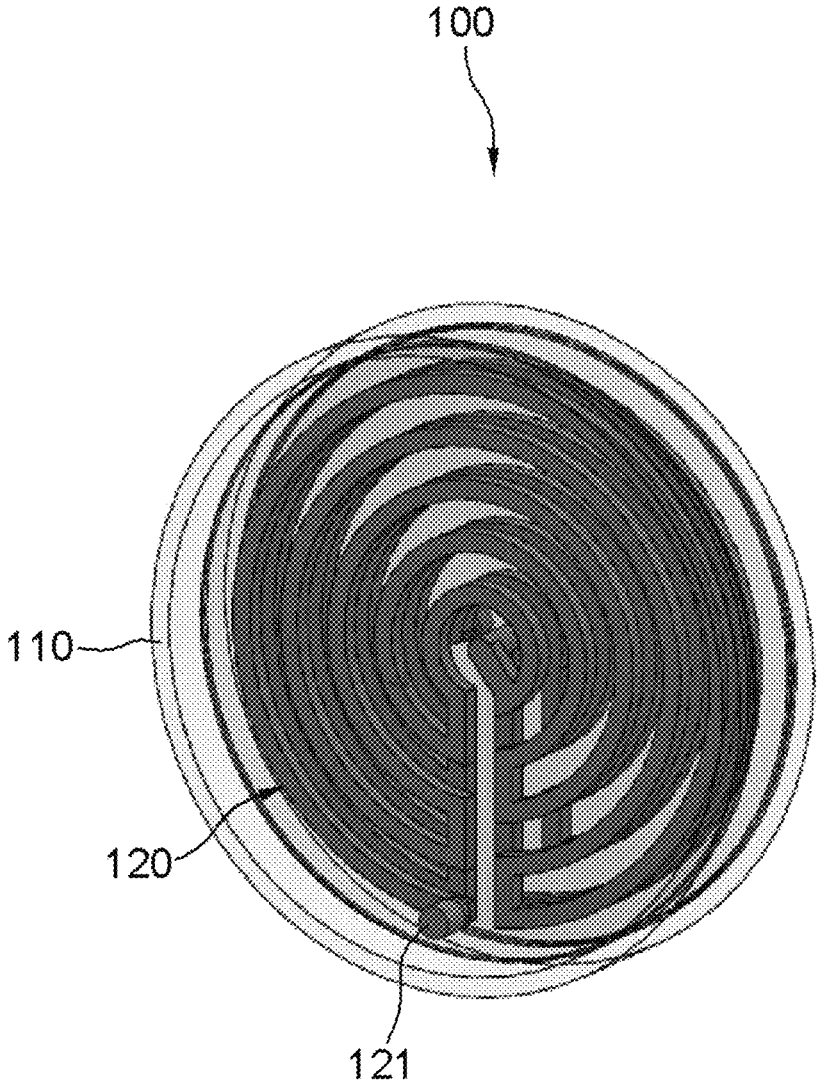
FIG. 1 is a perspective view illustrating a grill-integrated low-pass filter according to an embodiment of the present invention, which shows the configuration of the inner side thereof.
Figure 2:
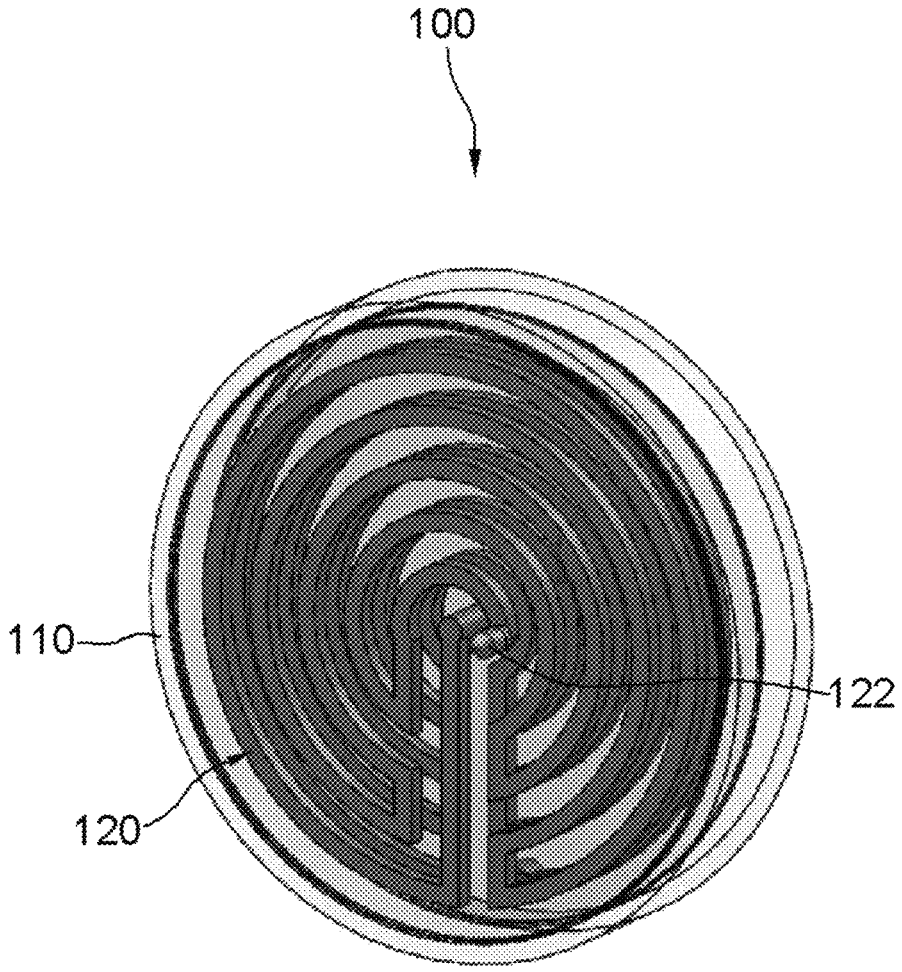
FIG. 2 is a perspective view illustrating the grill-integrated low-pass filter according to the embodiment of the present invention, which shows the configuration of the outer side thereof.

As shown in FIGS. 1 and 2, a grill-integrated low-pass filter 100 according to an embodiment of the present invention is configured such that a sound conduit is formed in a grill 110 assembled into a housing in which the sound conversion unit of a speaker is mounted and configured to function to protect a speaker driver, an internal circuit, etc. including the sound conversion unit in a tubular form and an integrated structure.

In other words, a conduit-type low-pass filter part 120 configured such that a sound conduit for the flow of sound is formed in an empty tubular shape is provided in the internal space of the grill 110, which is a mechanism that is assembled and used in the housing of the speaker, and is integrated with the grill 110.

The conduit-type low-pass filter part 120 may be formed in a single layer structure or two or more-layer structure with respect to the empty tubular sound conduit.

For example, the sound conduit itself may be formed in a two or more-layer structure, or grills 110 are constructed in two or three layers, thereby forming a 4 to 6 or more-layer structure.

The conduit-type low-pass filter part 120 may be formed in a spiral shape, as shown in the drawing, or may be formed in various shapes, such as an S shape, an inverted and reversed "L" shape, an "L" shape, etc.

In other words, the shape or structure of the conduit-type low-pass filter part 120 may be varied as desired.

Furthermore, the conduit-type low-pass filter part 120 is integrated with the grill 110, and is configured such that a sound conduit entrance 121 is provided on the inner side of the grill 110 and a sound conduit exit 122 is provided on the outer side of the grill 110 to be exposed to the outside. In some cases, the sound conduit entrance 121 and the sound conduit exit 122 may be located and provided on the opposite sides.

As an example, the conduit-type low-pass filter part 120 may be provided with a sound conduit formed in a spiral structure and may be configured such that the sound conduit entrance 121 is located and provided on the inner side of the grill 110, as shown in FIG. 1, and a sound conduit exit 122 is located and provided on the outer side of the grill 110, as shown in FIG. 2.

In this case, the locations of the sound conduit entrance 121 and the sound conduit exit 122 may be varied depending on the structural shape of the sound conduit or the shape structure of the grill 110 in the conduit-type low-pass filter part 120.

In this case, the conduit-type low-pass filter part 120 has a predetermined length and sectional area, and may be formed in various patterns. Sound quality is improved and also a maximum effect is achieved by varying the length and the sectional area.

In this case, it is preferred that the conduit-type low-pass filter part 120 is configured such that the length thereof is long and the sectional area thereof is small. Through this, rolling off is configured to be formed in a low-frequency band, and thus a maximum effect can be implemented due to the improvement of sound quality on a grill-integrated low-pass filter 100 side.

Figure 3:
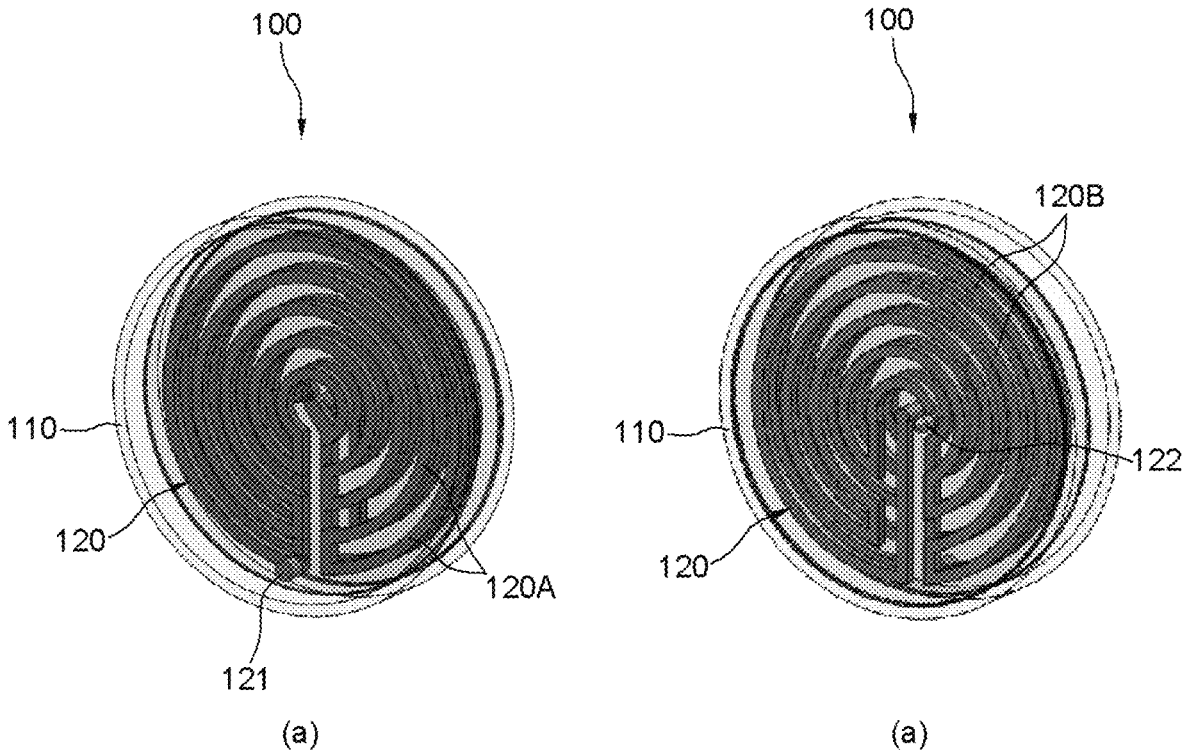
FIG. 3 is a perspective view illustrating the grill-integrated low-pass filter according to the embodiment of the present invention, wherein FIG. 3(*a*) shows the configuration of the inner side thereof, and FIG. 3(*b*) shows the configuration of the outer side thereof.

Furthermore, a grill-integrated low-pass filter 100 according to an embodiment of the present invention includes, for the conduit-type low-pass filter part 120, a first sound conduit 120A formed in a spiral structure and a second sound conduit 120B located under the first sound conduit 120A and formed in a spiral structure, thereby forming a two-layer structure, as shown in FIG. 3.

The first sound conduit 120A and the second sound conduit 120B are connected to each other at one side point, and are connected in a flue structure so that the flow of sound can be smoothly performed.

In this case, a sound conduit entrance 121 may be formed on the first sound conduit 120A and disposed on the inner side of the grill 110, and a sound conduit exit 122 may be formed on the second sound conduit 120B and disposed on the outer side of the grill 110 to be exposed to the outside.

In this case, the conduit-type low-pass filter part 120 has a predetermined length and sectional area, and may be formed in various patterns, as described above. Sound quality is improved and also a maximum effect is achieved by varying the length and the sectional area. By configuring the conduit-type low-pass filter part 120 so that the length thereof is long and the sectional area thereof is small, rolling off is formed in a low-frequency band, and thus a maximum effect can be implemented due to the improvement of sound quality on a grill-integrated low-pass filter 100 side.

Figure 4:
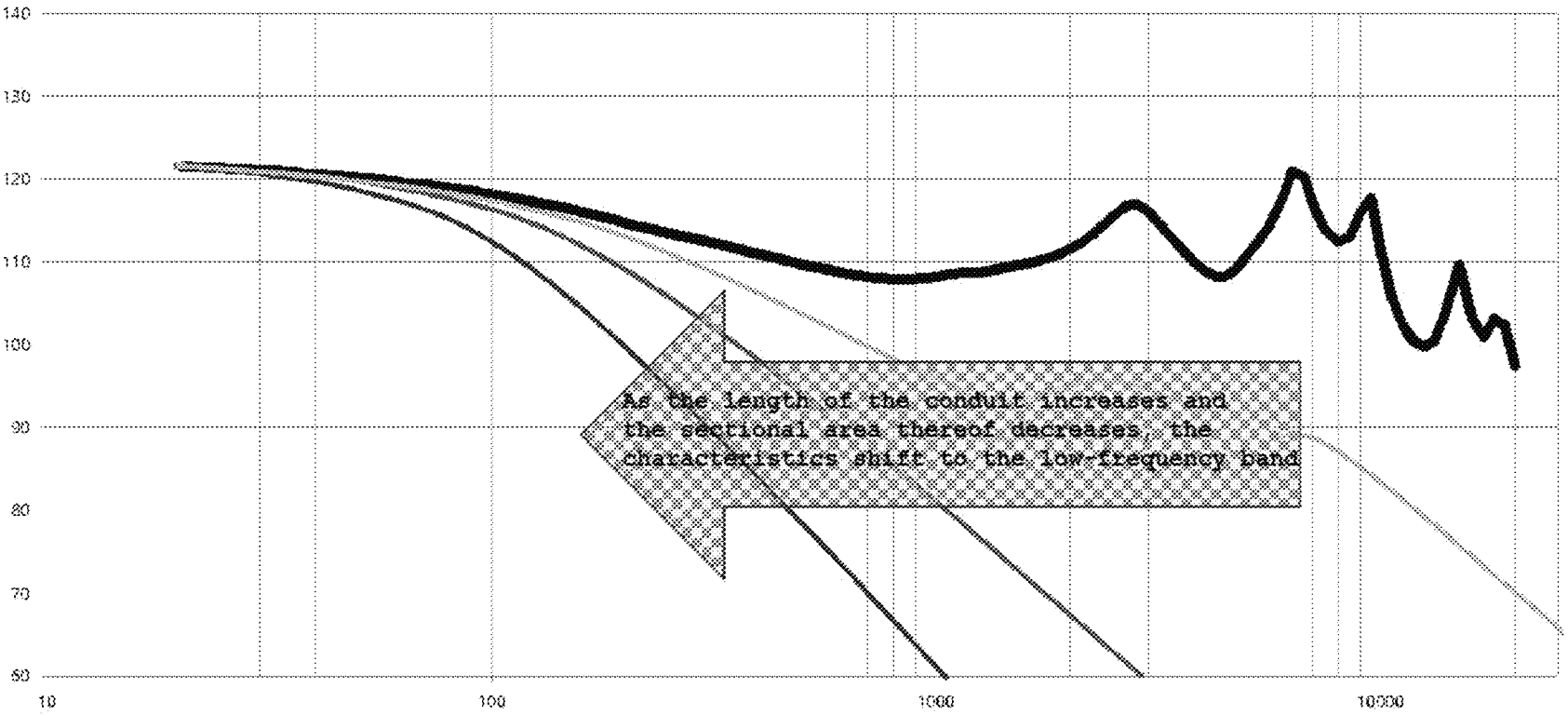
FIG. 4 is a graph showing the sound characteristics of the grill-integrated low-pass filter according to the embodiment of the present invention.

As shown in FIG. 4, the grill-integrated low-pass filter 100 according to the present invention, which is configured as described above, shows that as the length of the conduit-type low-pass filter part 120 side sound conduit increases and the sectional area decreases, the characteristics shift to the low-frequency band, and shows that rolling off is formed in the low-frequency band and thus the grill-integrated low-pass filter 100 may exhibit a maximum effect attributable to the improvement of sound quality.

Figure 5:
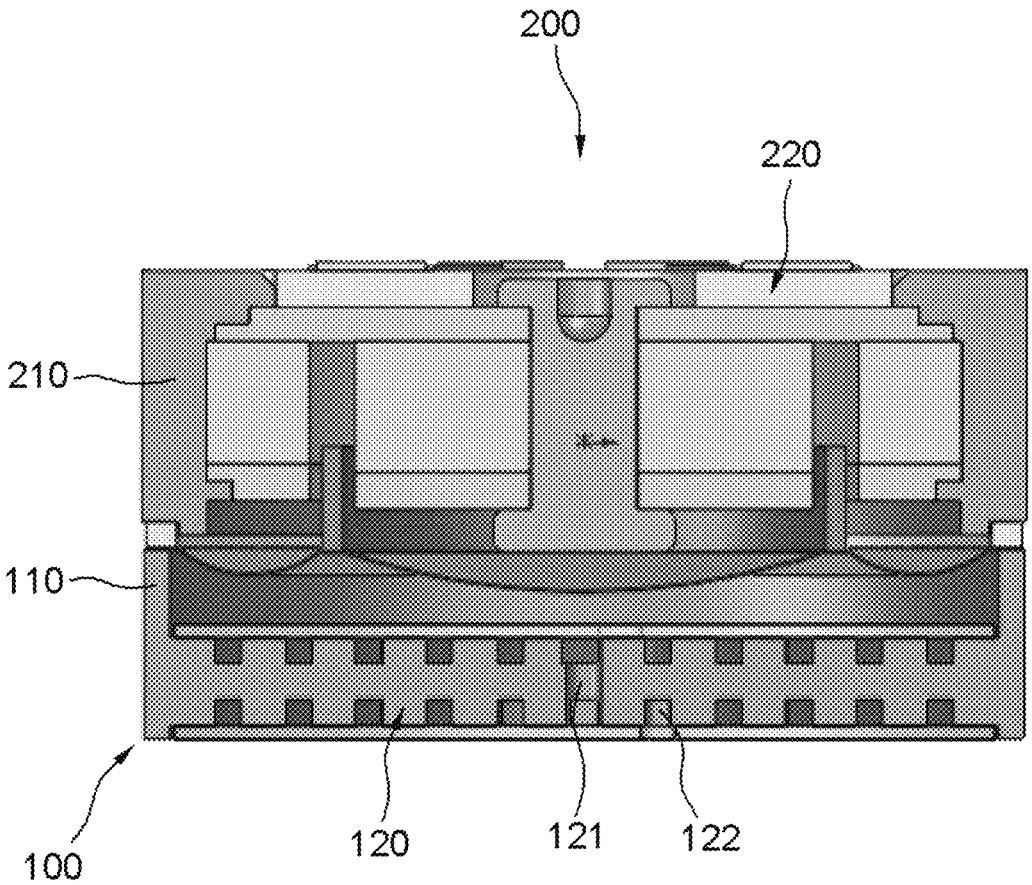
FIG. 5 is a sectional view showing the configuration of a speaker including the grill-integrated low-pass filter according to the embodiment of the present invention.

Meanwhile, as shown in FIG. 5, a speaker 200 including grill-integrated low-pass filter 100 according to the present invention, which is configured as described above, includes a housing 210 configured to form the appearance of the speaker, a sound conversion unit 220 mounted inside the housing 210, and a grill-integrated low-pass filter 100 disposed beneath the housing 210.

The housing 210 functions to protect the sound conversion unit 220.

The sound conversion unit 220 uses parts including a magnet, a yoke, a voice coil, and a diaphragm in order to generate sound.

In this case, the magnet is configured to generate magnetic force and made of a magnetic material having magnetism, the yoke is configured to concentrate the magnet-side magnetic force, mainly made of a paramagnetic material, and also configured to enable high-density uniform magnetic force to be achieved, the voice coil is configured to, when an electric signal having sound is applied, form a magnetic field and vibrate due to interaction with the magnet, and the diaphragm is configured to be vibrated by the voice coil-side vibration and generate sound.

In this case, the sound conversion unit 220 may include a printed circuit board (PCB) including a driver or internal circuit.

The grill-integrated low-pass filter 100 is provided to have the configuration and operation described in detail above with reference to FIGS. 1 to 4. Accordingly, a further detailed description thereof will be omitted, and the above description will be applied to the grill-integrated low-pass filter 100.

Therefore, according to the present invention, there are provided the grill-integrated low-pass filter that is designed in a structure in which the empty tubular sound conduit is formed inside the internal space of the grill disposed and used in a housing in order to protect a speaker driver, etc. and is thus fabricated in a grill-integrated form, thereby achieving the effects of improving the sound quality of the speaker and reducing characteristic deviations in a low-frequency band, and the speaker including the grill-integrated low-pass filter.

According to the present invention, there are provided the grill-integrated low-pass filter that can improve workability because the inconvenience of assembling additional parts into the speaker mechanism can be eliminated, that can be implemented in a form in which an electromagnetic part is not used, and that can implement lossless sound quality, and the speaker including the grill-integrated low-pass filter.

According to the present invention, there are provided the grill-integrated low-pass filter that is designed in a structure in which the conduit is formed in the grill itself, i.e., a speaker mechanism, so that the length and sectional area thereof are variable, through which the maximum effects of the low-pass filter can be obtained in such a manner that rolling off characteristics can be implemented even in a deep base equal to or lower than 100 Hz and so forth, and the speaker including the grill-integrated low-pass filter.

The above-described embodiments are intended merely to illustrate the technical spirit of the present invention. It will be apparent to those having ordinary skill in the art to which the present invention pertains that various modifications and alterations may be made to the above-described embodiments without departing from the essential features of the present invention.

The above-described embodiments are not intended to limit the technical spirit of the present invention but to illustrate it, and thus the scope of the present invention is not limited by the above-described embodiments. The scope of protection of the present invention should be construed by the claims, and all technical spirits equivalent thereto or deemed to be equivalent thereto should be construed as being included in the scope of the present invention.

What is claimed is:

1. A low-pass filter-type speaker cover comprising a conduit-type low-pass filter part in which a sound conduit is formed inside an internal space of the speaker cover, which is configured to be assembled in an exit portion of a speaker housing, in an empty tubular form, wherein a sound conduit entrance is configured to be disposed near an edge of a diaphragm and a sound conduit exit is formed at an end of a circular conduit of a spiral shape extended from the sound conduit entrance wherein the sound conduit entrance is vertically extended and configured to be protruded to an inside of the speaker housing, and the sound conduit exit is vertically extended and configured to be protruded to an outside of the speaker housing, thereby allowing sound waves and air to pass from the inside to the outside of the speaker housing, wherein a center of the diaphragm curves into the speaker cover, whereby the low-pass filter-type speaker cover functions not only as a speaker cover, but also as a low-pass filter.

2. The low-pass filter-type speaker cover of claim 1, wherein the conduit-type low-pass filter part has a predetermined length and a predetermined sectional area wherein the length and the sectional area are adjusted to improve sound quality.

3. The low-pass filter-type speaker cover of claim 2, wherein the length and the sectional area of the conduit-type low-pass filter part are configured such that rolling off is formed in a predetermined low-frequency band.

4. A speaker comprising:

a housing;

a sound conversion unit mounted inside the housing; and a low-pass filter-type speaker cover assembled into the housing;

wherein the low-pass filter-type speaker cover is the low-pass filter-type speaker cover set forth in claim 3.

5. A speaker comprising:

a housing;

a sound conversion unit mounted inside the housing; and a low-pass filter-type speaker cover assembled into the housing;

wherein the low-pass filter-type speaker cover is the low-pass filter-type speaker cover set forth in claim 2.

6. A speaker comprising:

a housing;

a sound conversion unit mounted inside the housing; and a low-pass filter-type speaker cover assembled into the housing;

wherein the low-pass filter-type speaker cover is the low-pass filter-type speaker cover set forth in claim 1.

* * * * *